US009851187B2

(12) United States Patent
Biggs et al.

(10) Patent No.: US 9,851,187 B2
(45) Date of Patent: Dec. 26, 2017

(54) SHOCK MITIGATION ASSEMBLY FOR A PENETRATING WEAPON

(71) Applicant: Raytheon Company, Waltham, MA (US)

(72) Inventors: Bradley M. Biggs, Corona, AZ (US); Tim B. Bonbrake, Tucson, AZ (US); Jesse T. Waddell, Tucson, AZ (US)

(73) Assignee: RAYTHEON COMPANY, Waltham, MA (US)

( * ) Notice: Subject to any disclaimer, the term of this patent is extended or adjusted under 35 U.S.C. 154(b) by 166 days.

(21) Appl. No.: 14/656,226

(22) Filed: Mar. 12, 2015

(65) Prior Publication Data

US 2016/0265888 A1 Sep. 15, 2016

(51) Int. Cl.
*F42B 12/20* (2006.01)
*F42C 11/00* (2006.01)

(52) U.S. Cl.
CPC ..... *F42B 12/207* (2013.01); *F42B 12/204* (2013.01); *F42B 12/208* (2013.01); *F42C 11/00* (2013.01)

(58) Field of Classification Search
CPC .... F42B 12/204; F42B 12/207; F42B 12/208; F42C 11/00
USPC .. 102/272–273, 275, 265, 479, 271, 275.12, 102/499
See application file for complete search history.

(56) References Cited

U.S. PATENT DOCUMENTS 2,449,540 A * 9/1948 Albin ..... F42B 4/22 102/340
3,035,521 A * 5/1962 Hynard ..... G04F 1/00 102/264
3,098,439 A * 7/1963 Berger ..... C07C 29/62 102/275
3,613,595 A * 10/1971 Blomgren ..... F42C 7/00 102/226
4,693,317 A 9/1987 Edwards et al.
5,698,814 A * 12/1997 Parsons ..... B26F 3/04 102/307
6,351,383 B1 * 2/2002 Payton ..... F42B 15/08 165/80.3
8,234,979 B1 * 8/2012 Falabella ..... F42B 12/207 102/275.9

(Continued)

*Primary Examiner* — John Cooper
(74) *Attorney, Agent, or Firm* — Renner, Otto, Boisselle & Sklar, LLP.

(57) ABSTRACT

A shock mitigation assembly for a penetrating explosive weapon having a first explosive charge and a second explosive charge includes an electronic circuit card having an electronic circuit formed therein, a weight attached to the circuit card to form a circuit card subassembly, a housing enclosing the subassembly, and a hyperelastic material between the housing and the subassembly for internal shock mitigation. The hyperelastic material has a modulus of elasticity that remains elastic characteristics with shock, temperature, or a combination of shock and temperature. The housing may include a casing and a cover with corresponding features that mate with one another and prevent separation of the cover from the casing. The casing also may have an external spiral flange that overlaps an internal spiral flange of a support for the casing, with a hyperelastic material between the casing and support for external shock mitigation.

8 Claims, 3 Drawing Sheets

(56) References Cited

U.S. PATENT DOCUMENTS

| | | | | |
|---|---|---|---|---|
| 8,297,189 | B2 * | 10/2012 | Hoffmann | F42C 19/02 102/275.11 |
| 2004/0130866 | A1 | 7/2004 | Itakura et al. | |
| 2006/0016360 | A1 * | 1/2006 | Eches | F42B 12/62 102/477 |
| 2012/0187235 | A1 * | 7/2012 | Bergmann | F42B 10/663 244/3.22 |
| 2012/0248670 | A1 | 10/2012 | Yamashita et al. | |
| 2013/0036899 | A1 | 2/2013 | Tucker | |
| 2013/0136525 | A1 | 5/2013 | Graham | |

* cited by examiner

SHOCK MITIGATION ASSEMBLY FOR A PENETRATING WEAPON

FIELD OF THE INVENTION

The present invention is related to a weapon system called a penetrator that is used to destroy hard targets, which typically are armored vehicles and at least one thing associated with a reinforced structure, buried underground, or combination. The present invention is also related to systems launched by gun firing. More particularly, the present invention is related to a method of shock mitigation for electronic components of a penetrating weapon, gun fired system, or combination and an assembly for mitigating shock for those electronic components.

BACKGROUND

A penetrating weapon system is designed to destroy hard targets, which typically are armored vehicles and at least one thing associated with a reinforced structure, buried underground, or combination. The penetrating system includes one or more explosive charges, and a fuze or portion of a fuze for detonating each charge. A fuze also may be an electronic safe and arm device (ESAD), electronic safe, arm, and fire (ESAF), warhead initiation module, or other electronics for initiating ordnance. Each fuze includes one or more electronic devices for controlling one or more electro-explosive devices. Each electro-explosive device initiates an explosive train which may include a charge, warhead, or combination.

The penetrating system, in the form of a bomb, shell, missile, or other munition, guided or unguided, has at least one charge called a penetrator or follow-through warhead. The penetrating system may have a second charge, such as a shaped-charge warhead. After proximity or impact to a surface, the shaped-charge warhead detonates and bores a passage for the follow-through warhead. Then the follow-through warhead penetrates and detonates to destroy the target, whether it is an armored ship or land vehicle, a reinforced building structure, a buried bunker, etc. Without the shaped charge warhead, the penetrator impacts a surface, penetrates, and detonates to destroy the target.

Systems launched by a gun may contain one or more explosive charges, electronics, and one or more electro-explosive initiators. Gun firing can apply setback acceleration and shock, balloting shock, and set forward acceleration and shock to the electronics and electro-explosive initiators.

The electronic device, electro-explosive device, or combination can be damaged and prevented from functioning properly due to mechanical shock from gun firing, as the penetrator impacts the structure, penetrates, slaps a structure, or from pyrotechnic shock from detonation of an explosive charge. Prior attempts to mitigate shock and thereby protect electronic components in a penetrator have included placing a plurality of glass beads between an electronics housing and an electronic device, placing a potting material between the housing and the electronic device, and mounting the electronic device in a metal cup and holding the cup in a metal housing with a metal cover.

SUMMARY

The present invention provides a means to protect an electronic device in an explosive weapon from shock and acceleration from gun firing and the shock of impact and shock from detonating an explosive so that the electronic device can still control detonation of an explosive.

More particularly, the present invention includes a shock mitigation assembly for a weapon having an explosive charge, where the shock mitigation assembly consists of a support with an internal spiral flange, an electronics package with an external spiral flange, and hyperelastic material between the support and the electronics package. Hyperelastic material is omitted from the explosive train interface between the fuze and an explosive charge for reliable initiation of the explosive charge, to facilitate venting to control explosive initiation from cook-off, or a combination thereof.

Paraphrasing the claims, the present invention also provides a shock mitigation assembly for an explosive weapon having an explosive charge that includes (a) an electronic device having an electronic circuit that is connectable to an electro-explosive device to control detonation of the explosive charge, (b) a weight attached to the electronic device to mitigate high frequency shock forces and to form an electronic subassembly that includes the electronic device and the weight, (c) a housing enclosing the electronic subassembly within an enclosed volume, and (d) a hyperelastic material between the housing and the electronic subassembly, where the hyperelastic material has a modulus of elasticity that has elastic characteristics with shock or temperature, or a combination of shock and temperature.

In the shock mitigation assembly, the electronic device may include a circuit card assembly that includes an electronic circuit, and the weight may be secured to the circuit card assembly.

The shock mitigation assembly may further include a fuze, connectable to an explosive to initiate detonation in response to a signal from the electronic circuit. The fuze may be mounted to the electronic device and incorporated into the electronic subassembly.

In the shock mitigation assembly, the weight may be attached to the electronic device with one or more of an adhesive, a potting material, one or more screws, bolts, rivets, weld, or a combination thereof.

The housing may include a casing and a cover secured to the casing, the casing and the cover cooperating to define the enclosed volume. The casing and the cover may include corresponding features that mate with one another and prevent separation of the cover from the casing, with a hyperelastic material filling a gap between the cover and the casing. The corresponding features may include facing threaded portions of the casing and the cover.

The shock mitigation assembly may further include a shock mitigation plate between the electronic subassembly and the cover. The shock mitigation plate may include a sheet of polyimide, epoxy fiberglass board, other shock dampening material, or combination thereof.

The present invention further provides a penetrating weapon having an outer casing enclosing a primary explosive and a secondary explosive, first and second fuzes coupled to respective ones of the primary explosive and the secondary explosive, and a shock mitigation assembly as described above, where the electronic circuit is connected to the first and second fuzes to selectively control detonation of the primary and secondary explosives.

The present invention further provides a shock mitigation assembly for an explosive weapon having an explosive charge that includes an electronics package having (a) an electronic subassembly including an electronic device having an electronic circuit that is connectable to an electro-explosive device to control detonation of the explosive charge, and (b) a casing enclosing the electronic subassembly within an enclosed volume. The casing has an external spiral flange configured to overlap with an internal spiral flange of a support, and a hyperelastic material fills a space between the casing and the support. The hyperelastic material has a modulus of elasticity that has elastic characteristics with shock or temperature, or a combination of shock and temperature.

The electronic subassembly may further include a weight attached to the electronic device to mitigate high frequency shock forces.

The electronic device may include a circuit card assembly that includes an electronic circuit, and the weight may be secured to the circuit card assembly.

The shock mitigation assembly may further include a hyperelastic material between the casing and the electronic subassembly.

The shock mitigation assembly may include a fuze, connectable to an explosive to initiate detonation in response to a signal from the electronic circuit, mounted to the electronic device and incorporated into the electronic subassembly.

The present invention also includes a penetrating weapon having an outer casing enclosing a primary explosive and a secondary explosive, and first and second fuzes coupled to respective ones of the primary explosive and the secondary explosive, and the shock mitigation assembly as described above, where the electronic circuit is connected to the first and second fuzes to selectively control detonation of the primary and secondary explosives.

The foregoing and other features of the invention are hereinafter fully described and particularly pointed out in the claims, the following description and the annexed drawings setting forth in detail one or more illustrative embodiments of the invention. These embodiments, however, are but a few of the various ways in which the principles of the invention can be employed. Other objects, advantages and features of the invention will become apparent from the following detailed description of the invention when considered in conjunction with the drawings.

DETAILED DESCRIPTION

The present invention provides a shock mitigation assembly to mitigate shock to an electronics package from the external support for the electronics package (i.e. external shock mitigation), and also provides a shock mitigation assembly to mitigate shock to an electronic device from the housing that encloses the electronic device (i.e. internal shock mitigation). Features that enable external shock mitigation, and features that enable internal shock mitigation, may be used separately or together to mitigate shock to relatively fragile electronic components of an explosive weapon, such as a penetrator or gun fired system, through a combination of structural mass and application of a hyperelastic material.

A hyperelastic material differs from an elastic material in that a hyperelastic material maintains elastic characteristics to protect electronics and initiators during shock or temperature, or a combination of shock and temperature. The temperature can include the operating temperature range of a weapon, such as from −54 C (or lower) to 71 C (or higher). In contrast, an elastic material hardens during shock or temperature, or a combination of shock and temperature, preventing an elastic material from protecting electronics and initiators during shock or temperature, or a combination of shock and temperature.

Shock is a sudden and often violent force, a force applied in a short time. The electronic components may need to be protected from shock, acceleration, and deceleration from gun firing, impact shock, penetration shock, and pyrotechnic shock. Impact shock can occur as the weapon impacts a hard media, such as the ground or a wall or other structure. Penetration shock can occur as the momentum of the weapon moves it through the media after impact. And pyrotechnic shock can occur due to the detonation of an explosive, including an explosive charge in the weapon itself. Impact, penetration, and pyrotechnic shock also include rebound shock from impact, penetration, pyrotechnic shock, or a combination. As a result, impact shock, penetration shock, structure slap shock, and/or pyrotechnic shock may prevent proper functioning of a penetrator by damaging electronic components in the penetrator, gun fired system, or a combination.

Figure 1:
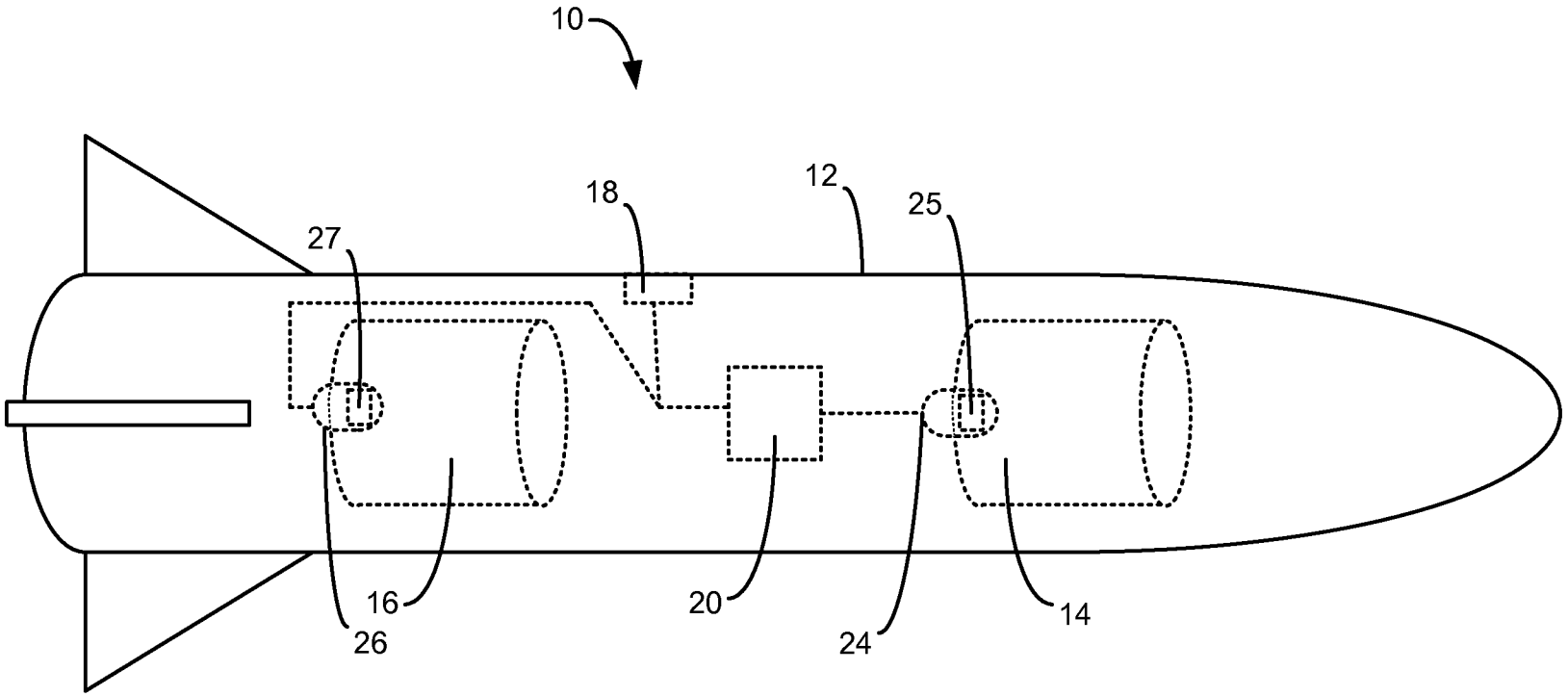
FIG. 1 is a schematic representation of a weapon system such as a missile, incorporating a protective assembly provided by the invention.

Turning now to the drawings, and initially to FIG. 1, an exemplary penetrator 10 has an outer casing 12 that encloses multiple charges. Two explosive charges are shown, including a primary charge 14, such as a shaped-charge, and a secondary charge or follow-through charge 16. Each charge 14 and 16 is controlled by a respective fuze 24 or 26. At least one of the fuzes 24 or 26 may be controlled by signals from an umbilical connector 18, the weapon subsystem controller 20, or a combination.

The primary charge 14 typically is initiated (detonated) before, upon, or after impact with a media to bore a hole in the media for further passage of the secondary charge 16. The impact, penetration, and initiation of the primary charge 14 or other part of the system applies impact shock, penetration shock, and pyrotechnic shock to fuzes 24 and 26.

The present invention provides at least one of external and internal shock mitigation to reduce the effects of gun firing, impact, penetration, and pyrotechnic shock on the fragile electronic components of the electronics package, electro-explosive initiator, or a combination thereof.

Figure 2:
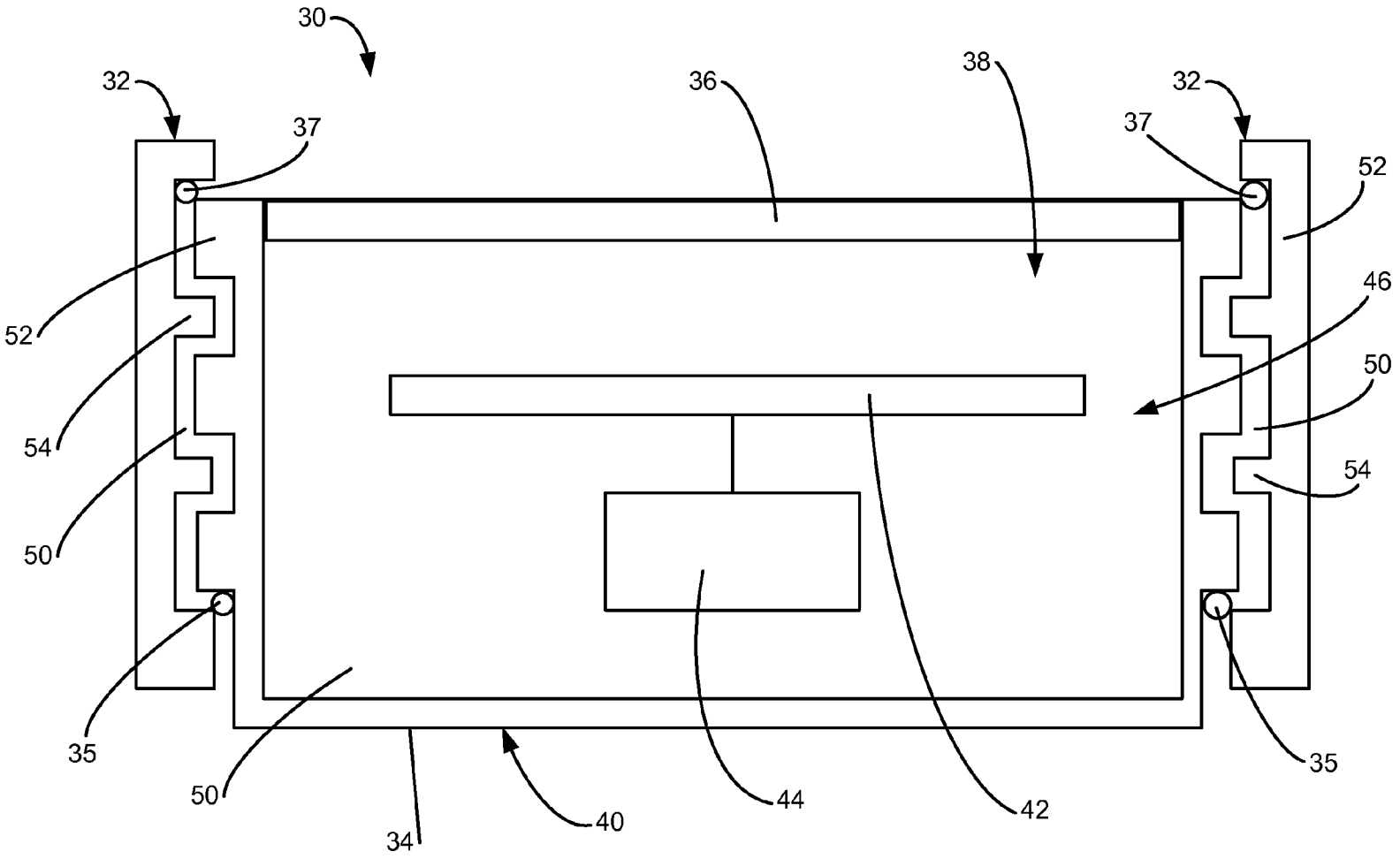
FIG. 2 is a schematic cross-sectional view of a protective assembly provided by the invention.

An exemplary shock mitigation assembly 30 with external shock mitigation features is shown in FIG. 2. The shock mitigation assembly 30 includes an electronics package 40 having a casing 34 with an external spiral flange 52 that cooperates with a support 32 with an internal spiral flange 54 to support the electronics package 40 relative to the support 32. A hyperelastic material 50 fills a gap between the support 32 and the electronics package 40. As noted above, a hyperelastic material has a modulus of elasticity that remains elastic with shock or temperature, or a combination of shock and temperature. An exemplary hyperelastic material includes silicone. The support 32 may be part of the outer casing 12 (FIG. 1) of a penetrator, a gun fired system, an electronics well, an electronics housing, or a combination.

The electronics package 40 includes a housing composed of the casing 34 and a cover 36. The cover 36 closes an opening in the casing 34, and cooperates with the casing 34 to define an enclosed volume 38. The cover 36 may be attached to the casing 34 with a threaded interface, screws, welding, or a combination thereof.

External shock mitigation is provided by a) the hyperelastic material 50 between the support 32 and the casing 34 and b) the mass of the electronics package 40. One or more, and two o-rings 35 and 37 in the illustrated embodiment, or other means of retaining the hyperelastic material 50 may be employed to retain the hyperelastic material 50 in the space between the casing 34 and the support 32 before the hyperelastic material 50 is cured. In the case of the overlapping spiral flanges 52 and 54 on the casing 34 and support 32, rotation of the casing 34 relative to the support 32 is required to remove the electronics package 40 from the casing 34. The spiral flanges 52 and 54 must extend a sufficient distance to be long enough to support the electronics package 40 with or without the hyperelastic material 50. Yet sufficient space is retained between the spiral flanges 52 and 54 for the hyperelastic material 50 to fill the gap between the support 32 and the casing 34.

The electronics package 40 further includes a controller or other electronic device with an electronic circuit, on one or more printed wiring boards, for example, enclosed in the casing 34. Thus the electronics package 40 includes a circuit card assembly 42 with an electronic circuit integrated into a semiconductor or otherwise mounted to a circuit board. The circuit card assembly 42 is enclosed in the enclosed volume 38 in the casing 34.

The shock mitigation assembly 30 also may include an explosive initiator (initiator 25 or 27 in FIG. 1) or a connector for attaching the circuit card assembly 42 or other electronics package to an explosive initiator (such as initiator 25 or 27 in FIG. 1). The electronics package 40 may be the fuze 26. A similar electronics package may be the fuze 24.

In the illustrated shock mitigation assembly 30, a weight 44 is connected to the circuit card assembly 42 to add mass to what is typically a relatively lightweight device. The weight 44 typically is made of a dense material, such as metal, to minimize the volume taken up by the weight 44. The weight 44 can be attached with any means of attachment, including mechanical fasteners, potting, an adhesive, etc., including combinations thereof.

The combination of the circuit card assembly 42 (or other electronic device) and the weight 44 forms a subassembly, which can be referred to as the electronic subassembly 46. Adding the weight 44 to the circuit card assembly 42 mechanically mitigates impact shock, penetration shock, and pyrotechnic shock by attenuating high frequency shock levels and frequencies. The frequency can be reduced according to the following relationship: frequency equals the square root of the modulus of the shock-carrying media divided by the combined mass of the electronic subassembly 46.

The illustrated electronic subassembly 46 also is separated from the inside surfaces of the housing (spaced from both the casing 34 and the cover 36) by a hyperelastic material 50 to provide internal shock mitigation. Providing the hyperelastic material 50 between the support 32 and the electronics package 40 reduces shock coupling between the support 32 and the electronic subassembly 46 to provide external shock mitigation and reduce shock damage to the electronic devices, such as a circuit card assembly 42. And providing the hyperelastic material 50 inside the electronics package 40, in the enclosed volume 38 provided by the casing and the cover 36, around the electronic subassembly 46, reduces shock coupling between the casing 34 and the cover 36 and the electronic subassembly 46 to provide internal shock mitigation and reduce shock damage to the circuit card assembly 42 and other electronic devices associated with the electronics package 40.

Figure 3:
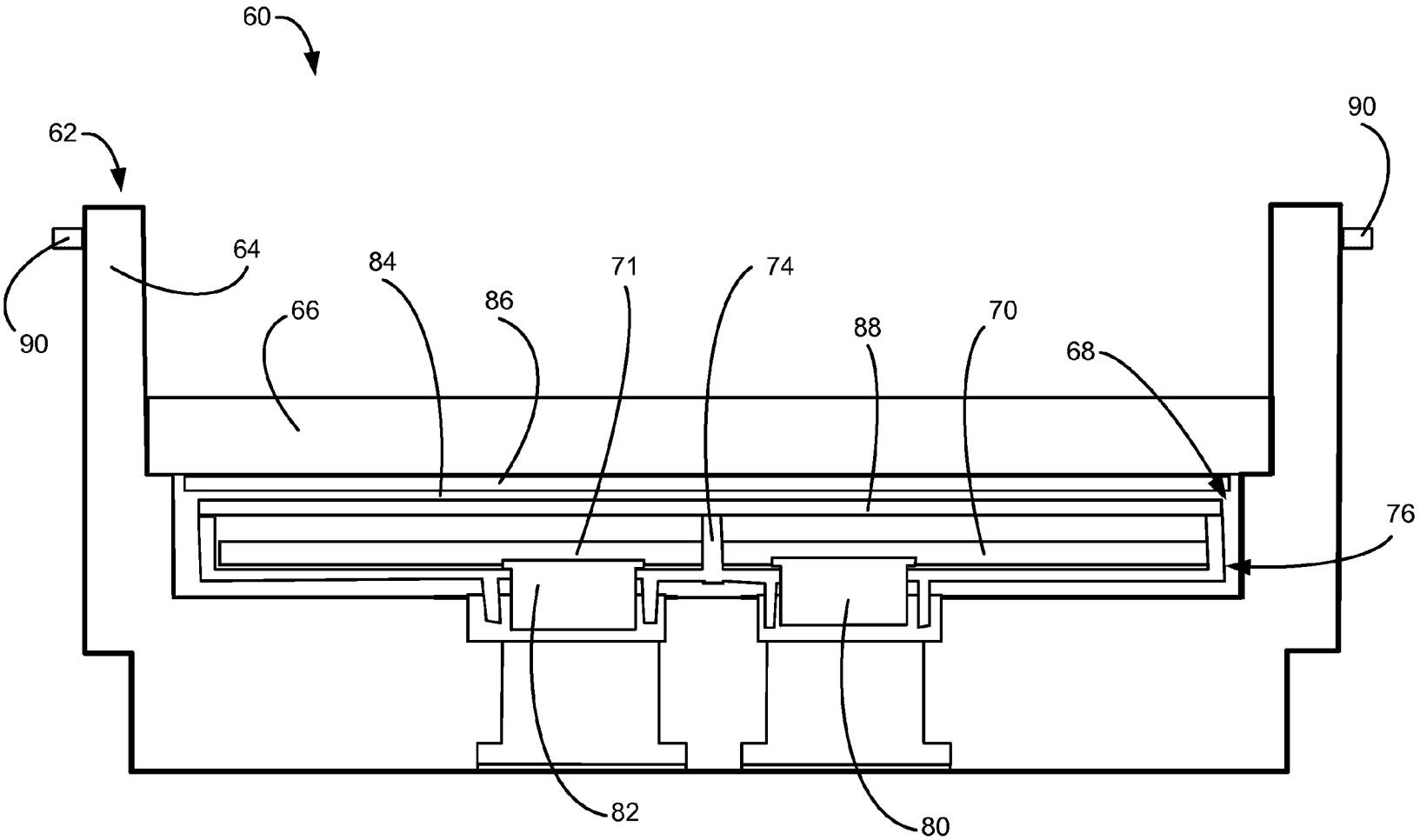
FIG. 3 is a schematic cross-sectional view of an exemplary protective assembly provided by the invention.

FIG. 3 shows an exemplary shock mitigation assembly 60. The illustrated shock mitigation assembly 60 includes a housing 62 having a casing 64 and a cover 66 that cooperates with the casing 64 to define an enclosed volume 68. The housing 62 may have a flange 90 along its outside diameter for securing the housing 62 to a support, such as a penetrator or gun fired projectile case 12, with a spanner nut, bolts, or other method. The cover 66 and the casing 64 may have corresponding threads again, with the threads on an outer surface of the cover 66 and an inner surface of the casing 64, or the cover 66 may be secured to the casing 64 in another way, such as with a spanner nut, screws, welding, or other method.

An electronics package having a resistor and other electronic devices on a printed wiring board, such as circuit card assemblies 70 and 71, is enclosed in the enclosed volume 68 in the housing 62. The circuit card assemblies 70 and 71 are held in the enclosed volume 68 in the housing 62, and a weight 74 is attached to the circuit card assemblies 70 and 71 to form an electronic subassembly 76. Attaching the weight 74 to the circuit card assemblies 70 and 71 over spaced-apart locations reduces flexure of the circuit card assemblies 70 and 71 due to shock forces, which helps to maintain electrical connections through solder joints in the circuit card assemblies 70 and 71 and prevents breakage of an electrical part, solder joint, a board conductor, etc., or a combination thereof, in the circuit card assemblies 70 and 71. Circuit card assemblies 70 and 71 can be similar to increase a system's reliability or different to provide more functionality.

An electro-explosive initiator or detonator often is mounted to an electronics housing with a spanner nut, which provides no shock mitigation between the housing and the electro-explosive initiator. In the illustrated shock mitigation assembly 60, however, a pair of electro-explosive initiators 80 and 82 are secured to the circuit card assembly 70, the weight 74, or a combination and thereby are integrated into the electronic subassembly 76.

The electronic subassembly 76 is spaced from the walls of the housing 62 (including both the casing 64 and the cover 66) by a hyperelastic material 84 once again, to mitigate the shock experienced by the electronic subassembly 76, protecting both the electro-explosive initiators 80 and 82 and the circuit card assembly 70.

The shock mitigation assembly 60 shown in FIG. 3 further includes a shock mitigator plate 86 between the electronic subassembly 76 and the housing 62, particularly between the electronic subassembly 76 and the cover 66. The shock mitigator plate 86 can be a sheet of polyimide, epoxy fiberglass board, other shock dampening plate material, or a combination. The illustrated shock mitigation assembly 60 may also include a lid 88 that is secured to the weight 74 with threads, welding, screws, an adhesive, or a combination thereof, to add further mass and protection to the electronic subassembly 76.

A shock mitigation assembly provided in accordance with these principles has increased the shock level for survivability of an electronic device by over a factor of three.

In summary, a shock mitigation assembly 60 for a penetrating explosive weapon 10 (FIG. 1) having a first explosive charge 14 (FIG. 1) and a second explosive charge 16 (FIG. 1) includes an electronic circuit card 42 (FIG. 2) or 70 (FIG. 3) having an electronic circuit formed therein, a weight 44 (FIG. 2) or 74 (FIG. 3) attached to the circuit card 42 or 70 to form a circuit card subassembly 46 or 76, a housing 62 enclosing the subassembly 76, and a hyperelastic material 50 or 84 between the housing 62 and the subassembly 76 for internal shock mitigation. The hyperelastic material 50 or 84 has a modulus of elasticity that remains elastic characteristics with shock, temperature, or a combination of shock and temperature. The housing 62 may include a casing 34 (FIG. 2) or 64 (FIG. 3) and a cover 36 (FIG. 2) or 66 (FIG. 3) with corresponding features that mate with one another and prevent separation of the cover 36 or 66 from the casing 34 or 64. The casing 34 (FIG. 2) also may have an external spiral flange 52 (FIG. 2) that overlaps an internal spiral flange 54 (FIG. 2) of a support 32 for the casing, with a hyperelastic material 50 between the casing and support for external shock mitigation.

Although the invention has been shown and described with respect to a certain preferred embodiment, it is obvious that equivalent alterations and modifications will occur to others skilled in the art upon the reading and understanding of this specification and the annexed drawings. In particular regard to the various functions performed by the above described components, the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention can have been disclosed with respect to only one of the several embodiments, such feature can be combined with one or more other features of the other embodiments as may be desired and advantageous for any given or particular application.

What is claimed is:

1. A shock mitigation assembly for an explosive weapon having an explosive charge, comprising:

an electronic device having an electronic circuit that is connectable to an electro-explosive device to control detonation of the explosive charge;

a weight attached to the electronic device to mitigate high frequency shock forces and to form an electronic subassembly that includes the electronic device and the weight;

a housing enclosing the electronic subassembly, including the weight, within an enclosed volume; and a hyperelastic material between the housing and the electronic subassembly, where the hyperelastic material has a modulus of elasticity that maintains elastic characteristics in response to shock, temperature, or a combination of shock and temperature;

where the housing includes a casing and a cover secured to the casing, the casing and the cover cooperating to define the enclosed volume, and the casing and the cover include corresponding features that mate with one another and prevent separation of the cover from the casing, and a hyperelastic material fills a gap between the cover and the casing.

2. The shock mitigation assembly as set forth in claim 1, where the electronic device includes a circuit card assembly that includes an electronic circuit, and the weight is secured to the circuit card assembly.

3. The shock mitigation assembly as set forth in claim 1, where a fuze, connectable to an explosive to initiate detonation in response to a signal from the electronic circuit, is mounted to the electronic device and incorporated into the electronic subassembly.

4. The shock mitigation assembly as set forth in claim 1, where the weight is attached to the electronic device with one or more of an adhesive, a potting material, one or more screws, bolts, rivets, weld, or a combination thereof.

5. The shock mitigation assembly as set forth in claim 1, where the corresponding features include facing threaded portions of the casing and the cover.

6. A shock mitigation assembly for an explosive weapon having an explosive charge, comprising:

an electronic device having an electronic circuit that is connectable to an electro-explosive device to control detonation of the explosive charge;

a weight attached to the electronic device to mitigate high frequency shock forces and to form an electronic subassembly that includes the electronic device and the weight;

a housing enclosing the electronic subassembly, including the weight, within an enclosed volume;

a hyperelastic material between the housing and the electronic subassembly, where the hyperelastic material has a modulus of elasticity that maintains elastic characteristics in response to shock, temperature, or a combination of shock and temperature; and a shock mitigation plate between the electronic subassembly and the cover;

where the housing includes a casing and a cover secured to the casing, the casing and the cover cooperating to define the enclosed volume, and the casing and the cover include corresponding features that mate with one another and prevent separation of the cover from the casing, and a hyperelastic material fills a gap between the cover and the casing.

7. The shock mitigation assembly as set forth in claim 6, where the shock mitigation plate includes a sheet of polyimide, epoxy fiberglass board, other shock dampening material, or combination thereof.

8. A penetrating weapon having an outer casing enclosing a primary explosive and a secondary explosive, and first and second fuzes coupled to respective ones of the primary explosive and the secondary explosive, and the shock mitigation assembly as set forth in claim 1, where the electronic circuit is connected to the first and second fuzes to selectively control detonation of the primary and secondary explosives.

* * * * *